US011097281B2

(12) United States Patent
Lindner

(10) Patent No.: US 11,097,281 B2
(45) Date of Patent: Aug. 24, 2021

(54) MOBILE WASTE COMMINUTING DEVICE COMPRISING A PARALLEL HYBRID DRIVE SYSTEM

(71) Applicant: Manuel Lindner, Spittal/Drau (AT)

(72) Inventor: Manuel Lindner, Spittal/Drau (AT)

(73) Assignee: Manuel Lindner, Spittal/Drau (AT)

( * ) Notice: Subject to any disclaimer, the term of this patent is extended or adjusted under 35 U.S.C. 154(b) by 343 days.

(21) Appl. No.: 16/306,414

(22) PCT Filed: May 23, 2017

(86) PCT No.: PCT/EP2017/062403
§ 371 (c)(1),
(2) Date: Nov. 30, 2018

(87) PCT Pub. No.: WO2017/207350
PCT Pub. Date: Dec. 7, 2017

(65) Prior Publication Data

US 2020/0316611 A1 Oct. 8, 2020

(30) Foreign Application Priority Data

Jun. 1, 2016 (EP) ..... 16172388

(51) Int. Cl.
*B02C 18/24* (2006.01)
*B02C 18/00* (2006.01)
*B02C 21/02* (2006.01)

(52) U.S. Cl.
CPC ..... *B02C 18/24* (2013.01); *B02C 18/0092* (2013.01); *B02C 21/026* (2013.01)

(58) Field of Classification Search
CPC ..... B02C 21/026; B02C 21/02; B02C 18/24; B02C 18/0092; B02C 18/14; B02C 13/30; B02C 4/42
See application file for complete search history.

(56) References Cited

U.S. PATENT DOCUMENTS 4,624,417 A 11/1986 Gangi
7,757,987 B2 * 7/2010 Kolbet ..... B02C 21/026 241/101.2

(Continued)

FOREIGN PATENT DOCUMENTS

CN 2819637 Y 9/2006
CN 202122998 U 1/2012

(Continued)

OTHER PUBLICATIONS

International Search Report issued for corresponding International Patent Application No. PCT/EP2017/062403 dated Aug. 10, 2017.

(Continued)

*Primary Examiner* — Faye Francis
(74) *Attorney, Agent, or Firm* — Moore & Van Allen PLLC; Henry B. Ward, III

(57) ABSTRACT

A waste shredding device including at least one shredding shaft; an internal combustion engine; a first and a second powertrain between the internal combustion engine and the shredding shaft; at least one energy converter coupled to the internal combustion engine in the first powertrain for converting mechanical energy of the internal combustion engine into storable energy; and at least one auxiliary motor supplied with the storable energy in the first powertrain for introducing mechanical energy into the first powertrain. The waste shredding device additionally includes an energy store for storing at least part of the storable energy in the event of periods with low power demand and for at least partially supplying the at least one auxiliary motor with the storable energy in the event of periods of high power demand.

19 Claims, 8 Drawing Sheets

(56) References Cited

U.S. PATENT DOCUMENTS

| | | | | |
|---|---|---|---|---|
| 9,700,896 | B1 * | 7/2017 | Gitschel | C10L 5/40 |
| 2011/0240778 | A1 | 10/2011 | Yamamoto et al. | |
| 2012/0234949 | A1 | 9/2012 | Morey | |
| 2013/0313351 | A1 * | 11/2013 | Beam, III | B02C 18/24 241/101.74 |

FOREIGN PATENT DOCUMENTS

| | | | |
|---|---|---|---|
| CN | 202590855 | U | 12/2012 |
| CN | 104014411 | A | 9/2014 |
| WO | 2014039603 | A1 | 3/2014 |

OTHER PUBLICATIONS

Written Opinion issued for corresponding International Patent Application No. PCT/EP2017/062403 dated Aug. 10, 2017 (English language translation not attached).

China Office Action issued by the China National Intellectual Property Administration for corresponding Chinese Patent Application No. 201780034398.2, dated Jun. 2, 2020, 12 pages.

Indian Examination Report issued by the Indian Patent Office for corresponding Indian Patent Application No. 201817048008, dated Dec. 31, 2019, 4 pages.

* cited by examiner

MOBILE WASTE COMMINUTING DEVICE COMPRISING A PARALLEL HYBRID DRIVE SYSTEM

FIELD OF INVENTION

The invention relates to a mobile shredding device comprising at least one shredding shaft and an internal combustion engine.

STATE OF THE ART

For shredding and processing machines (shredders) for various input materials (such as commercial waste, industrial waste, electronic scrap, metal scrap, plastics, composites, rubber, wood), mobile machines are often used, e.g. with road approval. The mobile shredding machines are usually used for changing locations. These shredding machines have one or more driven shredding shafts with which the input material is shredded.

Compared to stationary shredders, mobile shredders usually operate autonomously and do not require an external power supply. Due to the mostly missing power connection (e.g. electrical connection) it is therefore necessary that these machines are equipped with their own power supplier (preferably a diesel engine).

The diesel engine (industrial diesel engine) delivers a speed in the range of e.g. 1500-2100 rpm. In order that this speed can be adapted to the usually significantly lower shredding shaft speed of up to 1000 rpm and that a simple change in direction of rotation is also possible, a "hydraulic transmission" is usually used. Examples of commonly used shaft speeds are up to 80 rpm for a twin-shaft shredder, 5 to 200 or 90 to 500 rpm for a single-shaft shredder and 9 to 800 rpm for a (vertical) mill.

In all the following descriptions, both of the state of the art and of the description of the invention, only one component of the system is mentioned for reasons of simplification. Of course, two or more components can be present or provided in the system. For example, one shredding shaft or generator or electric motor is always mentioned. Depending on the shredding system, there may also be two or more shredding shafts. Also with regard to the drive components, it can be several internal combustion engines, generators, electric motors or energy stores and other multiple components.

A hydraulic drive is defined as one or more hydraulic pumps (directly flanged to the diesel engine or via transfer transmissions), which in turn drive one or more hydraulic motors on the shredding shafts directly or via a gear reducer. Both the pump(s) and the motor(s) are predominantly designed as an axial swivel pump(s) or motor(s), which is inevitably associated with a high noise level. With this constellation, the desired variability of the shredding shaft speed, shaft direction of rotation and shaft torque can easily be achieved.

In the case of shredders with the hydrostatic drive described here, the speed of the shredding shaft is predominantly controlled pressure-dependently in such a way that the hydraulic motor is operated at the highest possible speed in proportion to the torque required for shredding. This is necessary in order to achieve the highest possible throughput with a shredding system driven in this way.

When a certain predetermined hydraulic pressure is reached at the hydraulic motor(s), i.e. when the torque required for shredding is no longer sufficient and the pressure rises as a result, the speed of the shaft(s) is continuously reduced and the torque is increased proportionally at the same pressure. Either until a certain minimum speed is reached, or if the shaft(s) comes to a standstill, i.e. blockade, despite a reduction in speed and thus an increase in torque.

When the pressure required for shredding, and thus the torque, is reduced, the speed of the shaft(s) is continuously increased again until a predetermined pressure is reached.

For very high torques, the hydraulic drive components can also be designed very small with high speeds for cost efficiency, and the desired shredding shaft speed and torque can then be achieved via a reduction gear (reduction gear between hydraulic drive and shredding shaft(s)).

Due to the system, however, the energy efficiency of hydraulic drives results in a poor overall efficiency of approx. 0.14 to 0.24 (under the following exemplary but typical assumption: efficiency of the diesel engine 0.35 to 0.4 and efficiency of the hydraulic drive with partial load share of 0.4 to 0.6 depending on the share of full or partial load operation).

However, this poor efficiency of the hydrostatic system also means that larger cooling units must be provided for heat dissipation, which requires additional energy for the drive of the fans required for this purpose, which further impairs the efficiency.

An essential feature of these hydrostatic drives described here is that they do not have any possibility of a very short lasting power increase, since with the achievement of a maximum given pressure and minimum speed, i.e. maximum torque, the capacity of such a system is exhausted.

In the shredding processes described here, however, load peaks occur in the small millisecond (ms) range which cannot be covered by the hydrostatic drive system described here.

FIG. 1 shows in a measurement diagram the strongly changing torques of such a shredding process at short intervals and the resulting rapid changes in the speed of the shredding shaft.

If the torque required for shredding is not sufficient despite the reduction in the shaft speed, the shredding shaft is blocked.

In order to be able to continue the shredding process, the direction of rotation of the shaft is changed for a short period of time, i.e. a reversing process is carried out, and then the normal shredding process is resumed.

This could only be countered by increasing the capacity of this hydrostatic system by increasing the pump and motor size in such a way that only part of the capacity is used in the normal shredding process, so that when such power peaks are reached, an additional power reserve which can be called up immediately is available.

Such a solution is initially out of the question because of the higher costs and weight required, as well as the further deterioration in efficiency, since a hydrostatic drive system designed in this way would predominantly only operate at partial load.

The blockades of the shredding shaft caused by such power peaks and the forced reversing processes of the shaft, however, reduce the throughput capacity of such a hydrostatically driven shredder.

In addition, such a driven hydrostatic system at shredding devices is very slow in the reactions of the speed and thus the torque changes even within the performance limits of the system.

If a reduction of the speed is necessary at short intervals to increase the torque, but then an increase of the speed is possible at short notice and necessary to achieve the highest possible throughput, the control system of such a hydrostatic drive can only follow very slowly, which again is at the expense of the throughput capacity.

There is also a possible impact on the environment due to soil contamination, leakage of the hydraulic system or its malfunctions.

Mobile shredders are therefore operated as standard with a diesel engine as energy supplier. In the market for mobile shredders, the technical solution with a hydraulic drive has currently established itself as the most cost-effective, despite many disadvantages. This solution couples the diesel engine to the hydraulic drive (hydraulic pump(s) and hydraulic motor(s)) and optionally has a gear reducer. Mobile shredding machines of this type are very reliable and are known from the state of the art. For the different applications of mobile shredders, different versions of diesel-hydraulic drives are used.

Now, for the first time, there are also prototypes of shredding technology, e.g. for wood to produce so-called wood chips, and for crushing rock and concrete. The hydraulic pump on the diesel or internal combustion engine is replaced by a generator to generate electrical energy. The electrical energy thus generated is then converted back into mechanical energy by an electric motor to drive the shredding tools. However, these shredding units are only operated at an almost constant speed. There are only very small speed fluctuations between idling and the operation of such shredders.

With these electric drives, however, there is no reduction in the speed to increase the torque, as is the case with the hydrostatic drives described above. This is not technically possible with these shredding units either, as the actual shredding process would not be possible as a result.

With these electric drives, however, there is no reduction in the speed to increase the torque, as is the case with the hydrostatic drives described above and the new drive according to the invention. This is not technically possible with these shredding units either, as the actual shredding process would not be possible.

The energy stores through capacitors, so-called Super-CAPS, which are used in these shredding units do not serve to influence the speed, but are intended to cover very short power peaks, which the diesel drive cannot follow due to its inertia.

DESCRIPTION OF THE INVENTION

The object of the invention is to provide an energy-efficient mobile waste shredding device.

The object is solved by a mobile waste shredding device according to patent claim 1.

The waste shredding device according to the invention comprises: at least one shredding shaft; an internal combustion engine; a first and a second powertrain between the internal combustion engine and the shredding shaft; at least one energy converter coupled to the internal combustion engine in the first powertrain for converting mechanical energy of the internal combustion engine into storable energy; at least one auxiliary motor supplied with the storable energy in the first powertrain for introducing mechanical energy into the first powertrain; and an energy store for storing at least part of the storable energy and for at least partially supplying the at least one auxiliary motor with the storable energy, in particular for storing storable energy in the event of periods of low power demand and for delivering energy in the event of periods of high power demand.

The waste shredding device according to the invention thus comprises a drive in which a first powertrain and a second powertrain are implemented in parallel. In the second powertrain, the internal combustion engine is mechanically connected to at least one shredding shaft and can drive it directly (with the exception of a possible intermediate clutch or one or more intermediate transmissions). In the first powertrain, the mechanical energy of the internal combustion engine is converted via the energy converter into a form which can be stored on the one hand and with which on the other hand at least one auxiliary motor can be operated in order to drive the at least one shredding shaft as well.

The waste shredding device according to the invention can be further developed as follows:

The second powertrain may comprise a coupling for coupling the internal combustion engine to the at least one shredding shaft and/or a main gear on the at least one shredding shaft and/or a continuously variable transmission for changing the speed of the at least one shredding shaft. By means of the coupling, the connection of the internal combustion engine to the at least one shredding shaft can be mechanically separated. The main transmission can connect at least one shredding shaft with the second powertrain. With the continuously variable transmission, the speed of at least one shredding shaft can be continuously changed or adapted to a given shredding task.

The second powertrain may comprise a first transmission for adjusting the ratio of the speeds of the internal combustion engine and the at least one shredding shaft.

In the first powertrain, a second gear may be provided to adjust the ratio of the speed of the internal combustion engine and/or first gear and the speed of the energy converter. In this way, the proportion of energy generated in the first powertrain relative to the second powertrain can be adjusted.

In the first powertrain, a third transmission can be provided to adjust the ratio between the speed of the internal combustion engine and/or first transmission and the speed of the auxiliary motor. Thus the proportion of the energy supply in the first powertrain to the at least one shredding shaft relative to the energy supply in the second powertrain to the at least one shredding shaft can be adjusted.

The at least one energy converter and at least one auxiliary motor can form at least one energy converter/motor unit. This represents a particularly simple design of energy converter and auxiliary motor, for example as a generator/electric motor unit which acts as an electric motor when electrical energy is supplied and as a generator when mechanical energy is supplied, or as a hydraulic pump/hydraulic motor unit.

The at least one energy converter/motor unit can be coupled to the second powertrain via a transmission.

The at least one energy converter and the at least one auxiliary motor can alternatively form separate units, which are preferably coupled to the second powertrain via one transmission each.

The at least one energy converter may comprise at least one generator and the at least one auxiliary motor may comprise at least one electric motor or the at least one energy converter/motor unit may comprise at least one generator/electric motor unit. Thereby the first powertrain comprises electrical components. The generator/electric motor unit is hereinafter also referred to as the generator/motor unit.

Preferably further comprising: at least one AC/DC converter for converting alternating current from said at least one generator to direct current, a DC/AC converter for converting direct current to alternating current for said at least one electric motor, and an intermediate circuit disposed between said AC/DC converter and said DC/AC converter with an energy management module for coupling said energy store, each electric motor being an alternating current motor.

The energy store can comprise at least one electrical energy store and/or a mechanical energy store, wherein the electrical energy store comprises in particular a rechargeable battery and/or a capacitor and/or a superconducting magnetic energy store, and/or a static uninterruptible power supply, UPS, and/or wherein the mechanical energy store comprises in particular a dynamic UPS and/or a flywheel mass store and/or a flywheel store, wherein in the case of a mechanical energy store a converter device for converting electrical into mechanical energy and from mechanical into electrical energy is preferably provided.

The at least one energy converter can comprise at least one hydraulic pump and the at least one auxiliary motor can comprise at least one hydraulic motor or the at least one energy converter/motor unit can comprise at least one hydraulic pump/hydraulic motor unit. Thereby the first powertrain comprises hydraulic components.

A hydrostatic control unit may also be provided.

The energy store may comprise at least one hydraulic accumulator. Hydraulic energy generated by the hydraulic pump can be stored in this store or hydraulic energy can be taken from it to supply the hydraulic pump.

The hydraulic accumulator may comprise a gas-filled pressure vessel, in particular a diaphragm accumulator and/or a bladder accumulator and/or a piston accumulator and/or a metal bellows accumulator and/or a spring accumulator.

The mobile waste shredding device may comprise several shredding shafts, in particular two, three or four shredding shafts, for example in the form of a two-shaft shredder with counter-rotating shredding shafts.

The mobile waste shredding device may include an additional device for charging the energy store. This can be, for example, a small diesel engine/hydraulic pump unit or diesel engine/electric motor unit, which is provided and connected externally. The applied power is preferably in the range of 10 to 40 kW. Such an additional unit is particularly advantageous in the case of an above-mentioned energy converter/motor unit, for example to charge the energy store for a start process and to supply the energy converter/motor unit with energy.

A control unit can also be provided.

The control unit can be designed to control the mobile waste shredding device in such a way that, during a starting process and when the clutch is open, the auxiliary motor or the energy converter/motor unit drives the at least one shredding shaft by means of energy supply from the energy store until a synchronous rotational speed to the first gear is reached, whereupon the clutch is closed and preferably the energy supply from the energy store is stopped; or, during a starting process and when the clutch is closed, the auxiliary motor or the energy converter/motor unit, respectively, is started by means of energy supply from the energy store of the combustion engine and drives the at least the at least one shredding shaft and preferably the energy supply from the energy store is subsequently stopped; and/or if the torque required for shredding increases and thus the rotational speed of the internal combustion engine falls below a minimum value, then the at least one shredding shaft is driven by supply of energy from the energy store with the auxiliary motor or the energy converter/motor unit, respectively; and/or if the torque provided is still insufficient or if the at least one shredding shaft is blocked, then the clutch is opened and the further power supply via the auxiliary motor or the energy converter/motor unit is also stopped; and/or a reversing operation of the shafts with the clutch open and reversed direction of rotation of the at least one shredding shaft with the auxiliary motor and the energy converter/motor unit, respectively, is carried out by supplying energy from the energy store; and/or if the possible power of the internal combustion engine is not completely required for the direct drive of the at least one shredding shaft, then the energy store is charged via the energy converter or the energy converter/motor unit.

Further features and exemplary embodiments as well as advantages of the present invention are explained in more detail below on the basis of the drawing. It goes without saying that this embodiment cannot exhaust the entire scope of this invention. It also goes without saying that some or all of the features described below can be combined with each other in other ways.

EMBODIMENTS

Figure 1:
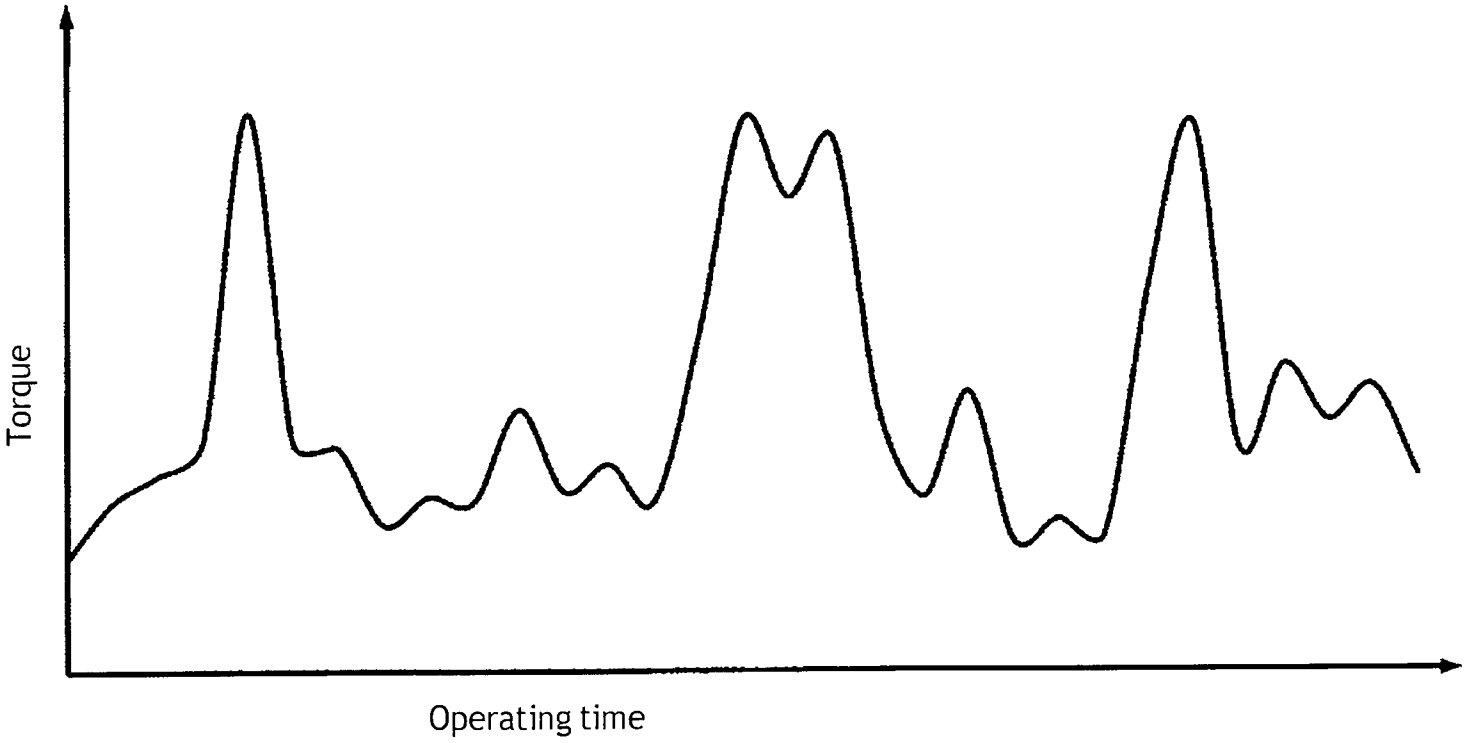
FIG. 1 shows a measuring diagram of torques of a shredding process.

The invention refers, according to an embodiment, to a mobile shredding device comprising at least one shredding shaft, an internal combustion engine and a generator coupled to the internal combustion engine for converting mechanical energy of the internal combustion engine into electrical energy, and at least one electric motor for converting electrical energy into mechanical energy for driving the shredding shaft(s), without and with the aid of an electrical or mechanical energy store. Furthermore, at least one clutch can be provided in the main powertrain for mechanically coupling the internal combustion engine to the shredding shaft(s) via gear stages. In one embodiment of the invention, the generator can be operated on the internal combustion engine, alternately as a generator and as a motor (generator/electric motor unit).

In a further embodiment, the internal combustion engine has at least one hydraulic pump for converting the mechanical energy into hydraulic energy, and at least one hydraulic motor for converting the hydraulic energy into mechanical energy for driving the shredding shaft(s), without and with the support of a hydraulic energy store. In one embodiment of the invention, the hydraulic pump can be operated on the internal combustion engine, alternately as a hydraulic pump and as a hydraulic motor. In a further embodiment a continuously variable transmission is provided in the main powertrain.

The object of the invention is to provide an energy-efficient mobile waste shredding device. The increase in efficiency is intended to enable the use of a smaller diesel engine or, with the same size of the diesel engine, an increase in throughput capacity. This should also lead to a reduction in CO2 emissions, both in absolute terms and specifically in terms of throughput.

By improving the efficiency and the associated increase in efficiency, the waste heat from the diesel engine, such as the waste heat from the hydraulic pump and hydraulic motor is completely eliminated, and in the preferred embodiment, only a small amount of waste heat is generated from the generator and electric motor and from the energy store. This further increases efficiency as the drive power of the fan drive of the cooling system is reduced.

The efficiency of the diesel engine of 0.35-0.4 can even be improved with the more energy-efficient drive in accordance with the invention, even if this does not seem possible due to the system. This is due to the possibility of choosing a smaller type of diesel engine with better efficiency. The diesel engine will also be able to operate at more constant power with the more energy-efficient drive according to the invention, since the periods of high power demand and the periods of low power demands are largely compensated for by the energy store and only to a small extent put strain on the diesel engine. A considerable specific improvement in consumption can therefore be expected.

The electrical efficiency can be improved from 0.4-0.6 to 0.8-0.9 compared to the hydrostatic drive according to the current state of the art, which, together with the improvement of the diesel engine, will lead to a considerable saving of approx. 35-45% in specific throughput. Even in the embodiment according to the invention with hydrostatic drive, there will still be a saving of at least 35-40%.

The conversion from hydraulic components according to the state of the art to electrical and hydraulic drive components according to the invention is associated with a considerable reduction of noise emissions of at least 5 dB(A).

This mobile waste shredding device according to invention comprises in the embodiments at least one shredding shaft 90/91, an internal combustion engine 10, a clutch 30, a first and a second powertrain between the internal combustion engine and the shredding shaft; a powertrain between clutch 30 and transmission 80 of the shredding shafts 90/91 as part of the second powertrain, in one of the embodiments, a continuously variable transmission 40 in the powertrain, a generator 20 coupled to the powertrain in front of the clutch, an electric motor 70 coupled behind the clutch, or a generator/electric motor as a unit 73, in one of the embodiments, a hydraulic pump 22 and a hydraulic motor 72, or a hydraulic pump/motor as unit 23, each for converting a part of the mechanical energy of the internal combustion engine into electrical or hydrostatic energy, an energy store 50 and 52 for storing the electrical or hydrostatic energy generated by the generator 20 or the hydraulic pump 22 or hydraulic pump/motor unit 22, respectively during idling or during periods of low power demand, as well as the control system 100 required to operate all these components with correspondingly complex software.

With this parallel hybrid drive solution, a shredding system with improved efficiency can be provided. It is particularly advantageous that almost the entire output of the internal combustion engine is available for the actual shredding after the mechanical connection between the internal combustion engine and the transmission of the shredding shaft has been established by the clutch 30. This achieves the technically highest possible degree of efficiency in the operating state.

With an additional energy store 50 and 52 for storing the electrical or hydrostatic energy generated by the generator or the hydraulic pump when the shredder is idling or during periods of low power demand, the electrical or hydrostatic energy generated in this way can be stored and thus fed to the shredding shafts 90/91 as additional mechanical energy at the start of the shredder and at periods of high power demand, with the electric motor 70, generator/motor unit 73, or hydraulic motor 72, pump/motor unit 23.

The electrical energy stores used are preferably rechargeable capacitors, so-called SuperCAPS, rechargeable batteries or accumulators, preferably based on lithium-ion cells, UPS (uninterruptible power supplies), hydraulic accumulators 52, e.g. bladder accumulators and electrical flywheel or compressed air accumulators.

The internal combustion engine 10 and the generator 20 or electric motor 70 or hydraulic pump 22 or hydraulic motor 72 are provided in a parallel hybrid arrangement, whereby the shredding shaft 90/91 can be directly driven by the internal combustion engine 10 via a clutch 30, in particular it is mechanically connected directly to the internal combustion engine 10, and the generator 20 or electric motor 70 or hydraulic pump 72 in a parallel powertrain draws its power with the main train in front of and behind the clutch 30 for recharging the stores or output it to the internal combustion engine as additional power.

The mobile waste shredding device according to the invention can be designed in such a way that a transmission arrangement 11 and 60 is provided for the adaptation of the ratio of the speeds of the internal combustion engine 10 and the shredding shaft 90/91.

In this way, the speed specified by the internal combustion engine 10 and the speed of the shredding shaft 90/91 can be matched to each other.

A change in the direction of rotation when the shaft is blocked is usually not carried out via a transmission, but directly by the parallel (first) powertrain provided in the electric or hydraulic motor by the change in the direction of rotation in the control system.

The gear arrangement may include a first transmission 11 for adjusting the ratio of the speeds of the internal combustion engine 10 and the generator 20 and the hydraulic pump 22, and/or a second transmission 60 for adjusting the ratio of the speeds of the electric motor 70 or hydraulic motor 72, the internal combustion engine 10 and the shredding shaft 90/91.

Another embodiment is that the internal combustion engine 10 and the electric motor 70, generator/motor unit 73, hydraulic motor 72, and hydraulic pump/motor unit 23, are provided in a parallel hybrid arrangement, the shredding shaft 90/91 being drivable with both the internal combustion engine 10 and the electric motor 70, generator/motor unit 73, hydraulic motor 72, and hydraulic pump/motor unit 23. Thus, both the major part of the mechanical power of the internal combustion engine 10 and the mechanical power of the electric motor 70, the generator/motor unit 73, hydraulic motor 72, and hydraulic pump/motor unit 23, can be used to drive the shredding shaft 90/91.

Another embodiment is that the second or third transmission 80 can be an appropriate reduction transmission, whereby the internal combustion engine 10, and the electric motor 70, generator/motor unit 73, hydraulic motor 72, and hydraulic pump/motor unit 23, are provided in a power split hybrid arrangement, and wherein the shredding shaft 90 is drivable both with the internal combustion engine 10, and with at least one electric motor 70, generator/motor unit 73, hydraulic motor 72, and hydraulic pump/motor unit 23.

In a further embodiment 120 and 220, after the clutch 30 of the main powertrain between the internal combustion engine and transmission 80 of the shredding shaft 90/91, a continuously variable transmission 40 is provided for speed variation. With this additional continuously variable transmission 40, the speed of the shredding shaft 90/91 can be adapted to the task of shredding. This is preferably not a matter of short-term speed changes, which can, for example, be carried out with an electric or hydraulic motor, but of a continuous adaptation of the shaft speed to the shredding task by means of an intelligent or self-learning control system.

The other embodiments 200, 210, and 220 include at least one shredding shaft 90/91; an internal combustion engine 10; a hydraulic pump 22 coupled to the internal combustion engine for converting mechanical energy of the internal combustion engine into hydraulic energy; or a hydraulic pump/motor unit 23, a hydraulic accumulator 52 for storing hydraulic energy generated by the hydraulic pump 22; and a hydraulic motor 72 or hydraulic pump/motor unit 23 supplied with the hydraulic energy for driving the at least one shredding shaft 90/91. This hybrid solution is based on a hydraulic system in which a hydraulic accumulator 52 is provided. When discharging the hydraulic accumulator, hydraulic energy (pressure*volume) can then be output.

The hydraulic accumulator 52 may comprise a pressure vessel filled with gas, in particular a diaphragm accumulator and/or a bladder accumulator and/or a piston accumulator and/or a metal bellows accumulator and/or a spring accumulator.

The function of the interaction of the internal combustion engine 10 to generate mechanical power; the clutch 30 to connect the powertrain of the internal combustion engine 10 to the transmission 80 of the shredding shaft 90/91; the generator 20 or the hydraulic pump 22, or hydraulic pump/motor unit 23, or generator/motor unit 73, to generate electrical or hydrostatic energy; and the electric or hydraulic motor 70 and 72, or the hydraulic pump/motor unit 23, or generator/motor unit 73 for converting the electrical or hydrostatic energy into a mechanical power for driving the shredding shaft 90/91, and an energy store 50 or 52 for covering the power required for starting and peak load, is ensured by a complex control 100 with corresponding software.

In all embodiments, the clutch 30 in the powertrain between the internal combustion engine and the transmission 80 of the shredding shaft 90/91 is open when the internal combustion engine 10 is started. In the embodiments 100, 120, 200 and 220 the transmission 12, which drives the generator 20, or a hydraulic pump 22, is in the powertrain in front of the clutch 30.

In the embodiments 100, 120, 200 and 220, the still open clutch 30 and the operating internal combustion engine 10 should ensure that the generator 20 or the hydraulic pump 22 still charges the energy store until the energy store 50 or 52 has the energy content required for starting the shredder. This is not provided for in embodiments 110 and 210.

In the embodiments 110 and 210, the generator/electric motor unit 73 or the hydraulic pump/motor unit 23 is driven by the transmission 13 behind the clutch 30, or it returns the stored and retrieved power via this transmission.

A so-called AC/DC converter 21 is mounted on generator 20 and an AC/DC/DC/AC converter 74 or frequency converter 74 is mounted directly or separately on generator/electric motor unit 73.

This AC/DC/DC 21 converter or frequency converter generates a so-called intermediate circuit as direct current with a voltage of 200 to 800 V, preferably 650 V. If more than one generator is used, however, only one intermediate circuit is formed.

In the embodiment 110, the electric motor and the generator form a structural unit in the form of a motor/generator unit 73. This is a compact form in which the motor/generator unit 73 functions first of all as an electric motor when supplied electrical energy is converted into mechanical energy and then also as a generator when supplied mechanical energy is converted into electrical energy for storage in the energy store 50.

In the embodiment 210, the hydraulic pump and hydraulic motor form a structural unit 23 in which the pump can also be operated as a motor via the switching valve 31, depending on whether power has to be fed into the hydraulic accumulator 52 or output by it.

In the embodiment 110, where the generator is simultaneously an electric motor and vice versa, the AC/DC converter is also designed as a DC/AC converter, and thus as an AC/DC/DC/AC converter 74 or frequency converter.

The electric motor 70 delivers the power after the clutch 30 back to the main powertrain via the transmission 60. The generator/electric motor unit 73 takes and delivers its power via the transmission 13 from/to the main powertrain, but after the clutch 30.

In the embodiments 100, 110 and 120 an energy store 50 is connected to the intermediate circuit. The energy store can be a capacitor, a battery or accumulator, a UVS uninterruptible power supply, or an electric flywheel accumulator. In the embodiments 200, 210 and 220, a hydraulic energy store 52 is provided, wherein immediately before the electric energy store or in the overall control, a corresponding management of the energy store 51 is provided for loading and unloading. With the hydraulic energy store, this function is achieved with control valves 31.

A combination of several identical or several different energy stores is also possible. For example, a battery energy store for the starting process of the shredder and a condenser for covering the peak load.

The function of these components is provided as follows in the control technology for embodiments 100, 120, 200 and 220. As soon as the internal combustion engine 10 is at rated speed, preferably between 1,100 and 2,400 rpm depending on the engine type, the generator 20 or the hydraulic pump 22 is switched on and the energy store 50 or 52 is thus charged.

If the energy store 50 or 52 has the energy content required for a start process, the actual start process can begin. In all embodiments, the electric motor 70, the generator/electric motor unit 73, the hydraulic motor 72, and the hydraulic pump/motor unit 23, via the transmissions 12 and 13 or 60, and the main transmission 80, bring the shredding shaft 90/91 to the specified speed. The energy requirement is covered by the energy store 50 or 52, as the clutch 30 to the internal combustion engine 10 is still open.

As soon as the input speed of the transmission 80 has reached the same speed as the output of the transmission 11, i.e. the speeds are almost synchronous, the clutch 30 is closed and the internal combustion engine 10 is mechanically connected directly to the shredding shaft 90/91 via the transmission 80.

As soon as the clutch 30 is closed and the speed of the shredding shaft 90 is constant after the clutch 30 is closed, the electric motor 70 or hydraulic motor 72 stops the power supply via the transmission 60 to the main powertrain. The shredding shafts 90/91 are then only driven directly by the internal combustion engine 10.

In the embodiments 110 and 210, the starting procedure and function are different from those described above for the embodiments 110, 120, 200 and 220.

After starting the internal combustion engine 10 and reaching the preset speed, the generator/motor unit 73, or the hydraulic pump/motor unit 23, is put into operation as an electric or hydraulic motor while the clutch 30 is still open, and the power generated in this way is transferred via the transmission 13 to the main powertrain to the transmission 80, thus bringing the shafts 90/91 to the preset speed.

As soon as the input speed of the transmission 80 has reached the same speed as the input or output of the transmission 13 facing the clutch 30, i.e. the speeds are almost synchronous, the clutch 30 is closed and the internal combustion engine 10 is mechanically connected directly to the shredding shaft 90/91 via the transmission 80.

In all embodiments 100, 110, 120, 200, 210 and 220, the almost synchronous speed is reached and the clutch 30 is closed, and after closing the clutch 30 the speed of the shredding shaft 90/91 is constant, the electric motor 70, or hydraulic motor 72 via the transmission 60, or the generator/electric motor unit 23, or hydraulic pump/motor unit 23, terminates the power supply via the transmission 13 into the main powertrain. The shredding shafts 90/91 are now only operated directly from the internal combustion engine 10.

As can be seen from FIG. 1, the shredding process takes place with highly changing torques and thus highly changing power consumption of the internal combustion engine 10. The diagram clearly shows so-called load peaks and periods with low load demand. In the embodiment according to the invention, the nominal power of the system and thus of the diesel or internal combustion engine 10 will preferably be formed in the middle between the expected load peaks and periods of low load demand.

Since the internal combustion engine 10 cannot cover the load peaks with this design, additional energy must be supplied to the shredding system. The energy required to cover the load peaks is provided by the energy store 50 or 52. The internal combustion engine 10 is preferably operated in the rated load range.

The additional power required to cover the load peaks is applied by the energy store 50 or 52 and transferred to the drive main train by the electric motor 70, or the generator/electric motor unit 73, or the hydraulic motor 72, or by the hydraulic pump/motor unit 23, as a power supply to cover the load peaks via the transmissions 13 or 60.

Since the load peaks do not have to be covered by the power of the internal combustion engine 10, a smaller size of the internal combustion engine is possible.

If periods of low load demand occur again, as can be seen from the graphic in FIG. 1, the energy store 50 or 52 is recharged via the generator 20, or the generator/electric motor unit 73, or the hydraulic pump 22, or the hydraulic pump/motor unit 23, so that the stored energy is available for further covering of load peaks.

Figure 2:
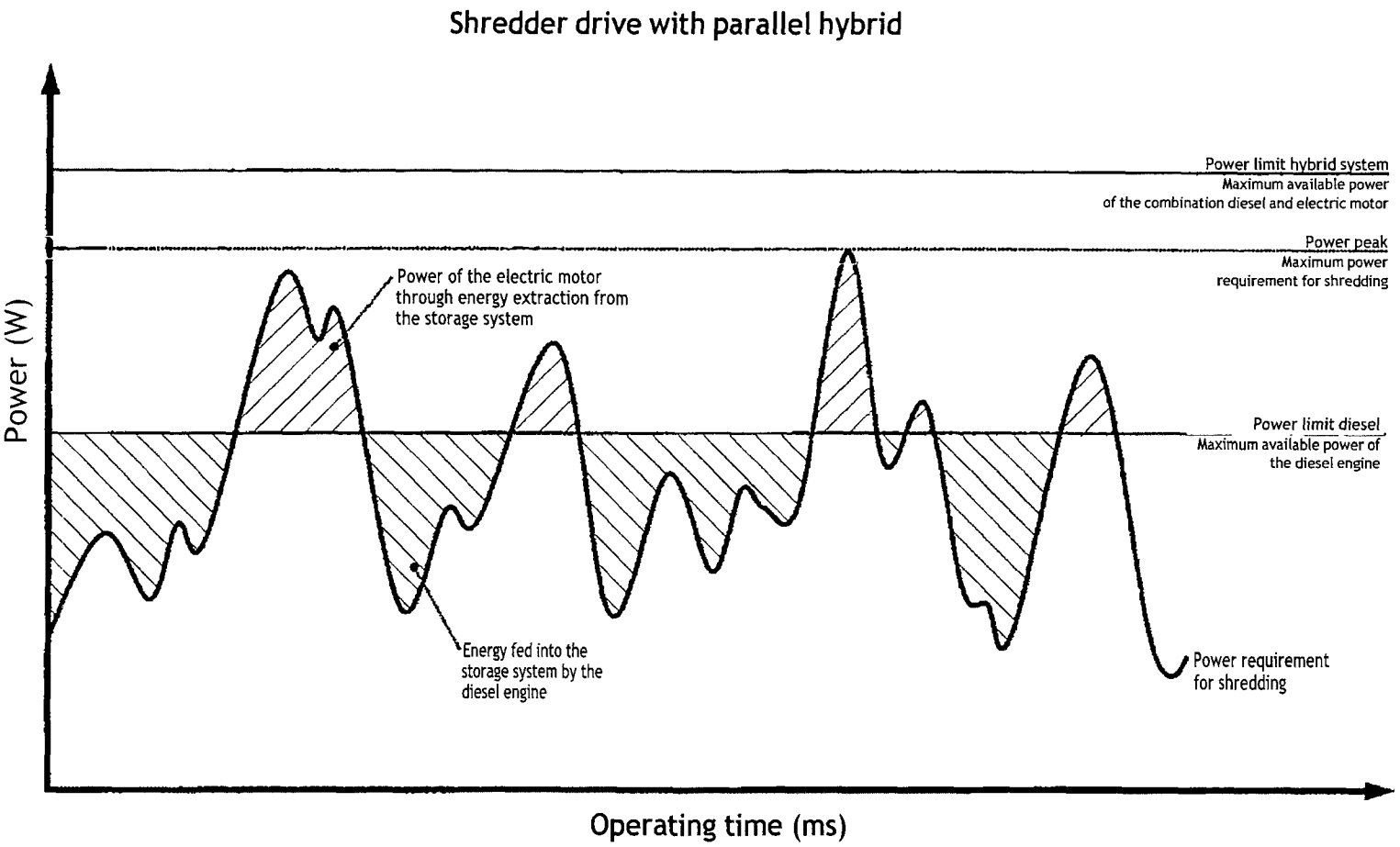
FIG. 2 illustrates the mode of operation of the waste shredding device according to the invention.

The graphic FIG. 2 illustrates the mode of operation of the embodiments according to the invention very clearly. Graphic FIG. 2 shows the power limit of the internal combustion engine 10, preferably designed as a diesel engine. This is the maximum power that the diesel engine is capable of delivering. Then the graphic shows the power limit of the entire hybrid system, i.e. the sum of the power of the combustion diesel engine 10 and the electric motor 70, the hydraulic motor 72, the generator/engine unit 73, and the hydraulic pump/engine unit 23. The curve in the graph shows the power requirement for the shredding task. The part exceeding the power limit of the internal combustion engine/diesel engine 10, i.e. the power peaks, are covered by the additional power of the electric motor 70, or hydraulic motor 72, or the generator/electric motor units 73, or by the hydraulic pump/motor unit 23, in addition to the internal combustion engine 10. In the area where the combustion/diesel engine 10 does not have to have the power limit, i.e. in the periods with low power demand, the remaining part up to the power limit can be used by the generator 20, the hydraulic pump 22, the generator/electric motor unit 73, the hydraulic pump/motor unit 23, to charge the energy stores 50 and 52.

If an additional short-term power from the energy store 50 or 52, for an additional power supply via the electric motor 70, or via the generator/electric motor unit 73, or via the hydraulic motor 72, or the hydraulic pump/motor unit 23, is applied to the power of the internal combustion engine 10, which is also connected with an increase of the torque on the shredding shaft 90/91, and the specified speed of the shredding shaft 90/91 can still not be kept within the permissible range, or even the shredding shaft 90/91 is blocked, the clutch 30 is immediately opened.

The direction of rotation of the electric motor 70, or the generator/electric motor unit 73, hydraulic motor 72, or the hydraulic pump/motor unit 23, is changed immediately. Thus the direction of rotation of the shredding shafts 90/91 is also changed and a so-called reversing process of the shafts 90/91 is initiated.

By changing the direction of rotation and thus the shredding shaft 90/91, a so-called relieve of the shredding shaft 90/91 is to be achieved.

If the direction of rotation of the shredding shaft 90/91 is normal or if the direction of rotation of the shredding shaft has changed, the control process described above will set the corresponding speed, the maximum permissible current consumption of the electric motor 70, or the generator/electric motor unit 73, or the maximum pressure of the hydraulic motor 72, or the hydraulic pump/motor unit 23, and the duration of the changed direction of rotation freely selectable by the control system.

As soon as the period of the changed direction of rotation of the shredding shaft 90/91 has elapsed, the start procedure described above for the normal direction of rotation is initiated again.

Due to the direct coupling of the internal combustion engine 10 with the shredding shafts 90/91 via the main gear 80, the design and inertia of the internal combustion engine 10 results in a very narrow spectrum of a speed and thus torque range in which the shredding of the respective input material is possible.

If the input material is such that it requires a different speed or torque range than that resulting from the mechanical coupling between the internal combustion engine 10 and the shredding shaft 90/91, frequent blockades and the associated change in the direction of rotation or a reversing process of the shredding shaft 90/91 occur. This considerably reduces the throughput or can be completely impossible.

Therefore, in the further embodiment 120 and 220 it is suggested to provide preferably a continuously variable transmission 40. With this additional transmission it is possible to select the correct speed or torque range for the respective shredding task. In this way the blockades or reversing processes of the shredding shaft 90/91 which reduce the throughput can be avoided or at least reduced.

It is not necessarily the intention to make rapid changes to the speed of the shredding shaft 90/91 with the continuously variable transmission 40. Rather, the best speed and thus torque range of the shredding shaft 90/91 should preferably be permanently and continuously adapted to the shredding task by means of an intelligent and self-learning control system with the continuously variable gear 40.

The embodiment 120 with the generator 20 and the electric motor 70, the embodiment 220 with the hydraulic pump 22 and the hydraulic motor 72, in connection with the continuously variable transmission 40 can also be further developed so that the continuously variable transmission 40 is used as in the embodiment 110 with the generator/electric motor unit 73, and in the embodiment 210 with the hydraulic pump/motor unit 23.

The drawings show exemplary embodiments 100, 110, 120, 200, 210 and 220.

Here 10 is the diesel or internal combustion engine, 11 is a reduction or transmission gear for adjusting the speed of the internal combustion engine 10 to the main transmission 80, 12 is the first gear for the output to the components 20, 22, 13, is the further gear as input and output of the components 23 and 73, 20 is the generator, 21 is the AC/DC converter or frequency converter, 23 is the hydraulic pump/motor unit, 30 is the clutch, 40 is the continuously variable transmission, 50 is the electric energy store, 51 is the energy management required for this, 52 is the hydraulic energy store, 60 is the second transmission for the output of the components 70 and 72, 70 is the electric motor, 71 is the DC/AC converter, 72 is the hydraulic motor, 73 is the electric generator/motor unit, 80 is the main transmission, 90/91 are the two shredding shafts, 100 is the control for all components.

The following embodiments 100, 110, 120, 200, 210 and 220 are only examples and the complete scope of the present invention is defined by the claims.

For all the transmissions 11, 12, 13 and 60 described in the various embodiments, other transmission elements such as V-belts or toothed belts etc. can also be provided. The design as a transmission or spur gear unit is only an example here.

The drawings show exemplary embodiments 100, 110, 120, 200, 210 and 220.

10 is the diesel or internal combustion engine, 11 is a reduction or transmission gear for adapting the speed of the internal combustion engine 10 to the main gear 80, 12 is the first transmission for the output to the components 20, 22, 13 is the further gear as input and output of the components 23 and 73, 20 is the generator, 21 is the AC/DC converter or frequency converter, respectively, 23 is the hydraulic pump/motor unit, 30 is the clutch, 40 is the continuously variable transmission, 50 is the electric energy store, 51 is the energy management required for this, 52 is the hydraulic energy store, 60 is the second transmission for the output of the components 70 and 72, 70 is the electric motor, 71 is the DC/AC converter, 72 is the hydraulic motor, 73 is the electric generator/motor unit, 80 is the main transmission, 90/91 the two shredding shafts, 100 the control for all components.

DESCRIPTION OF THE EMBODIMENTS SHOWN IN THE DRAWINGS

The following embodiments 100, 110, 120, 200, 210 and 220 are only examples and the complete scope of this invention is defined by the claims.

For all transmissions 11, 12, 13 and 60 described in the various embodiments, other transmission elements such as V-belts or toothed belts etc. can also be provided. The design as gear unit or spur gear unit is only an example here.

Embodiment 100

Figure 3:
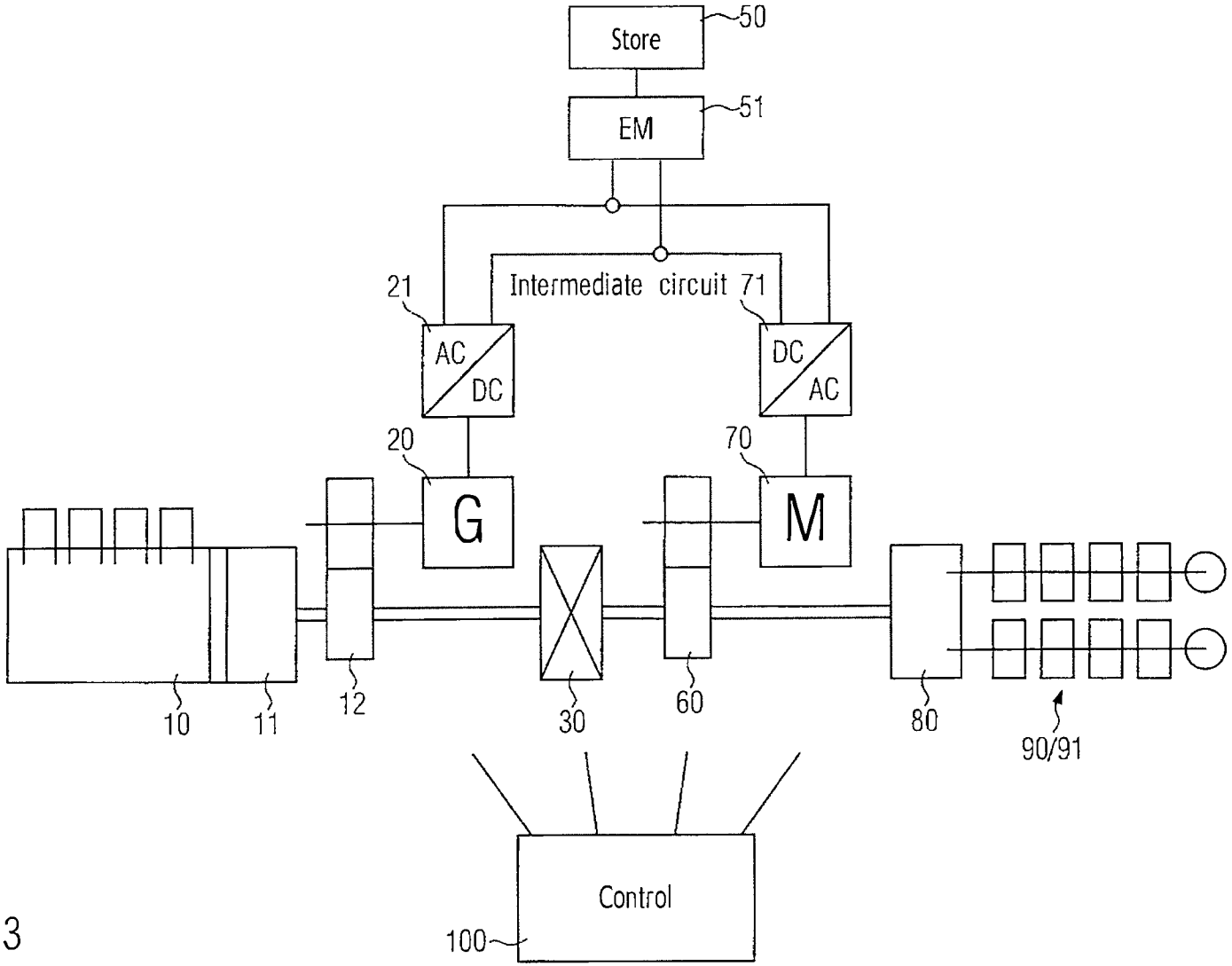
FIG. 3 shows a first embodiment of the mobile waste shredding device according to the invention.

FIG. 3 shows this embodiment 100 of the waste shredding device and comprises in this embodiment the shredding shaft 90/91; an internal combustion engine (diesel engine) 10; a first transmission 11 for adjusting the speed; another transmission 12 for coupling with the generator; the generator 20 for converting mechanical energy of the internal combustion engine 10 into electrical energy; the AC/DC converter 21; the clutch 30; the energy store 50; the energy store management 51; the further transmission 60 for coupling with the electric motor; the electric motor 70 for converting the electrical energy into mechanical energy; the DC/AC converter 71; the main transmission 80; the clutch 30 for establishing a mechanical connection between the output of the transmission 12 and the input of the transmission 6050, and the overall control 100.

The internal combustion engine 10, the generator 20 and the electric motor 70 with transmission 60 are provided in this exemplary embodiment 100 in a parallel hybrid arrangement, whereby the shredding shaft 90/91 is drivable both with the electric motor 70 and the internal combustion engine 10 with closed clutch 30. The power and torque components of the internal combustion engine 10 and the electric motor 70 can be divided depending on the speed of the shredding shaft 90/91 with the clutch 30 closed.

The first transmission 11 is designed as a spur gear in order to adjust the speed of the internal combustion engine 10 to that of the main transmission 80. The second transmission 12 increases the speed of the generator 20. The third transmission 60 reduces the speed of the electric motor 70 to the desired input speed of the transmission 80. This enables a smaller design of the electric motor 70, since otherwise—without the third transmission 60—the electric motor 70 would have to apply a large torque at comparatively low speeds, which can only be achieved by a larger design of the electric motor 70.

The third transmission 60 can also be used to reverse the direction of rotation of the shredding shaft 90/91, whereby the electric motor 70 is operated in the opposite direction of rotation when the clutch 30 is open.

The clutch 30, between the outlet of the transmission 12 and the inlet of the transmission 80, takes over the task, after the electric motor 70, supplied with energy from the energy store 50 has driven the shredding shaft 90/91 to the given speed and almost synchronous with the outlet of the transmission 12 via the transmission 60 and the main transmission 80, to establish a direct mechanical connection between the internal combustion engine 10, via the transmission 11, 12 and 80, with the shaft 90/91 when the clutch is still open.

The mobile waste shredding device of the embodiment 100 further comprises an AC/DC converter 21, and a DC/AC converter 71, an energy store (e.g. rechargeable battery) 50 with energy storage management 51 for storing electrical energy generated by the generator 20. The mobile waste shredder 100 also includes a control unit 100 for controlling the internal combustion engine 10, generator 20 and electric motor 70 to provide the required power, torque and speed for the shredding shaft 90/91, respectively, and to provide sufficient charging of the energy store 50. The control unit 100 can also be used to control the energy store 50 if no separate energy management 51 is provided.

Embodiment 110

Figure 4:
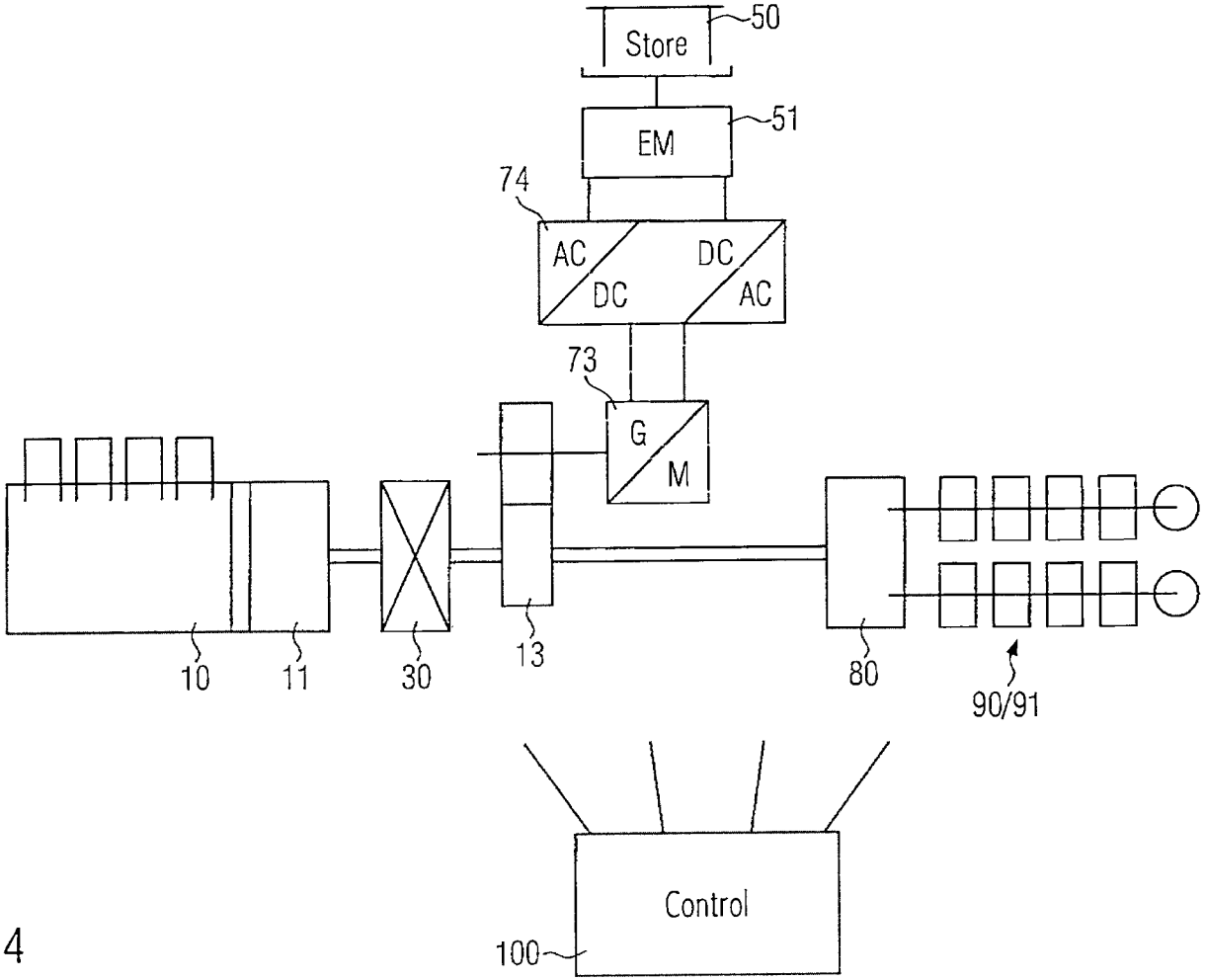
FIG. 4 shows a second embodiment of the mobile waste shredding device according to the invention.

FIG. 4 shows a second embodiment 110 of the waste shredding device according to the invention. The same reference numerals here designate the same components as in FIG. 100 Only the additional or modified components are described below.

The electric motor 70 and the generator 20 of the first embodiment 100 are designed here as a motor/generator unit 73. The internal combustion engine 10 and the engine/generator unit 73 are each coupled to a transmission arrangement 13, whereby this transmission is located compared to the first embodiment 100 behind the clutch 30. This transmission 13 is in turn coupled to the main transmission 80 and this to the shredding shaft 90/91.

The internal combustion engine 10 and the motor/generator unit 73 with AC/DC/DC/AC converter 74, in this embodiment 110 are also in a parallel hybrid arrangement, which means that the shredding shaft 90/91 can be driven via the main transmission 80, both with the internal combustion engine 10 and with the engine/generator unit 73.

Thus, the majority of the mechanical power of the internal combustion engine 10 as well as the mechanical power of the motor/generator unit 73 can be used to drive the shredding shaft 90/91.

In a shredding device state where the mechanical power of the motor/generator unit 73 is not required, the energy store 50 can be charged via the energy management 51 by the motor/generator unit 73 generating electrical energy mechanically driven by the internal combustion engine 10.

In this embodiment, the energy store 50 is not charged by the generator 20, and the direction of rotation is not changed by the motor 70, but by the generator/motor unit 73.

The clutch 30 between the outlet of the transmission 11 and the inlet of the transmission 12, which is directly mechanically connected to the main transmission 80, takes over the task, after the generator/electric motor unit 73, supplied with energy from the energy store 50, via the transmission 13 and the main transmission 80, the shredding shaft 90/91 has been driven to the predetermined rotational speed which is substantially synchronous with the output of the transmission 11, by closing the clutch 30, to establish a direct mechanical connection between the internal combustion engine 10, via the transmissions 11, 13 and 80, with the shaft 90/91.

Since the embodiment 110 has a generator/electric motor unit 73 compared to the embodiment 100, this is supplied with electrical energy by an AC/DC/DC/AC. Otherwise, embodiment 110 is designed in the same way as embodiment 100.

Embodiment 120

Figure 5:
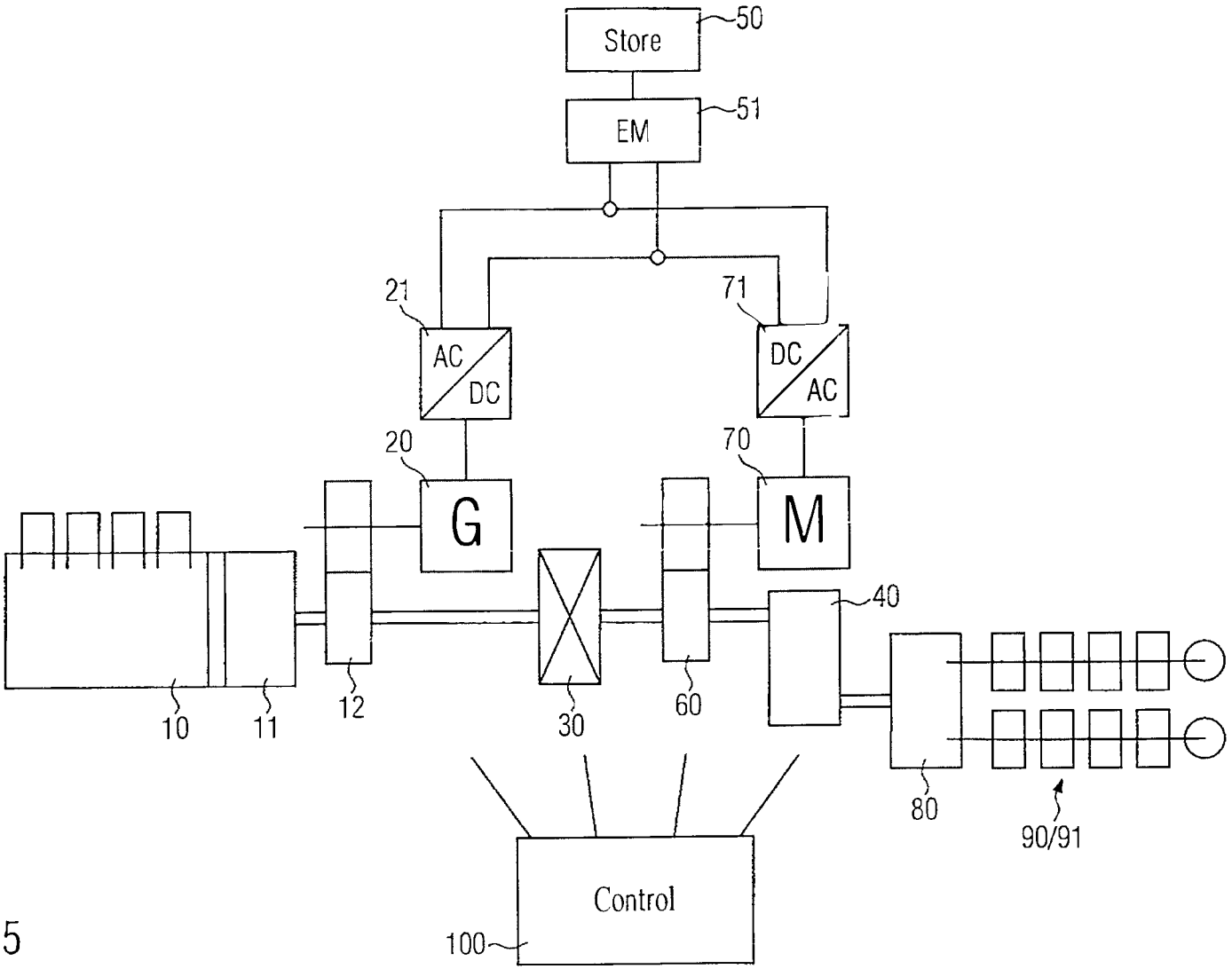
FIG. 5 shows a third embodiment of the mobile waste shredding device according to the invention.

FIG. 5 shows a third embodiment 120 of the mobile waste shredding device according to the invention, which is similar in structure to the first embodiment 100. The same reference numerals here designate the same components as in FIG. 3 in embodiment 100. Therefore only the additional components are described in the following.

In this embodiment 120, the mobile waste shredding device comprises, as in embodiment 100, a first transmission 11, a second transmission 12, a clutch 30, and the third transmission 60. Then, in the embodiment 120, in contrast to the embodiment 100, the continuously variable transmission 40 is additionally provided, in which the transmission ratio and thus the speed at the input of the main transmission 80, and thus at the shafts 90/91, can be continuously adjusted.

All other components and the function of embodiment 120 are identical with embodiment 100.

Embodiment 200

Figure 6:
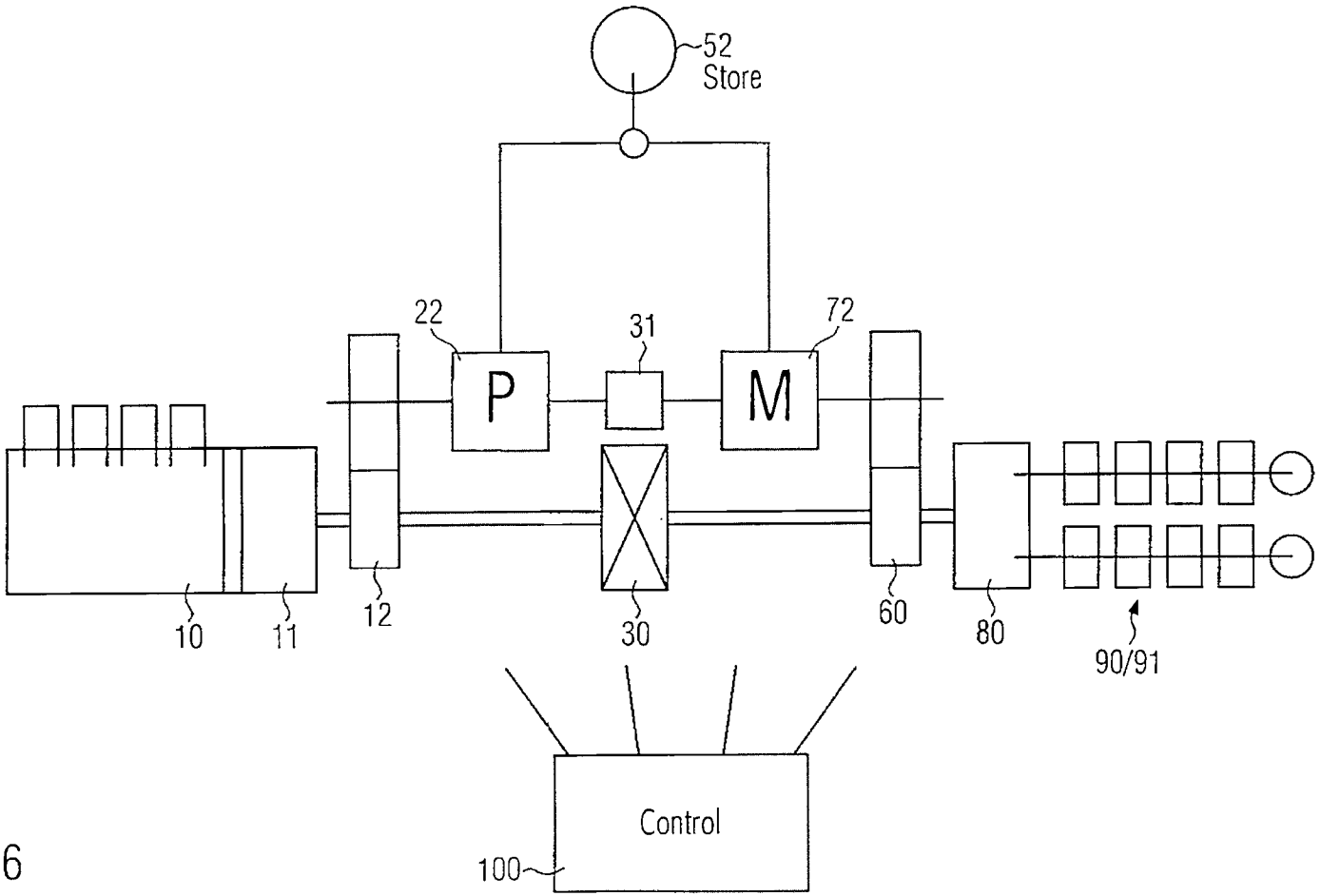
FIG. 6 shows a fourth embodiment of the mobile waste shredding device according to the invention.

FIG. 6 shows a fourth embodiment 200 of the mobile waste shredding device according to the invention, analogous to the first embodiment 100, which, however, is based on a hydraulic and non-electric drive concept.

The same reference numerals here refer to the same components as in FIG. 3 in embodiment 100. Therefore, only the additional components are described below.

In this embodiment, the mobile waste shredding device 200 comprises a shredding shaft 90/91; an internal combustion engine 10; a hydraulic pump 22 coupled to the internal combustion engine 100 via the transmission 12 for converting mechanical energy of the internal combustion engine 10 into hydraulic energy; a hydraulic accumulator 52 for storing hydraulic energy generated by the hydraulic pump 22; and a hydraulic motor 72 supplied with this hydraulic energy for driving the at least one shredding shaft 90/90 via the transmissions 60 and 80, and a hydrostatic control unit.

The hydraulic accumulator 52 preferably comprises a gas-filled pressure vessel in which a hydraulic fluid is stored under pressure and can release hydraulic energy when relieved of pressure.

The internal combustion engine 10 and the hydraulic motor 72 are provided in a power-split hybrid arrangement. The other components of embodiment 200, i.e. with the exception of 22, 31, 72 and 52, are identical to embodiment 100 in function.

Embodiment 210

Figure 7:
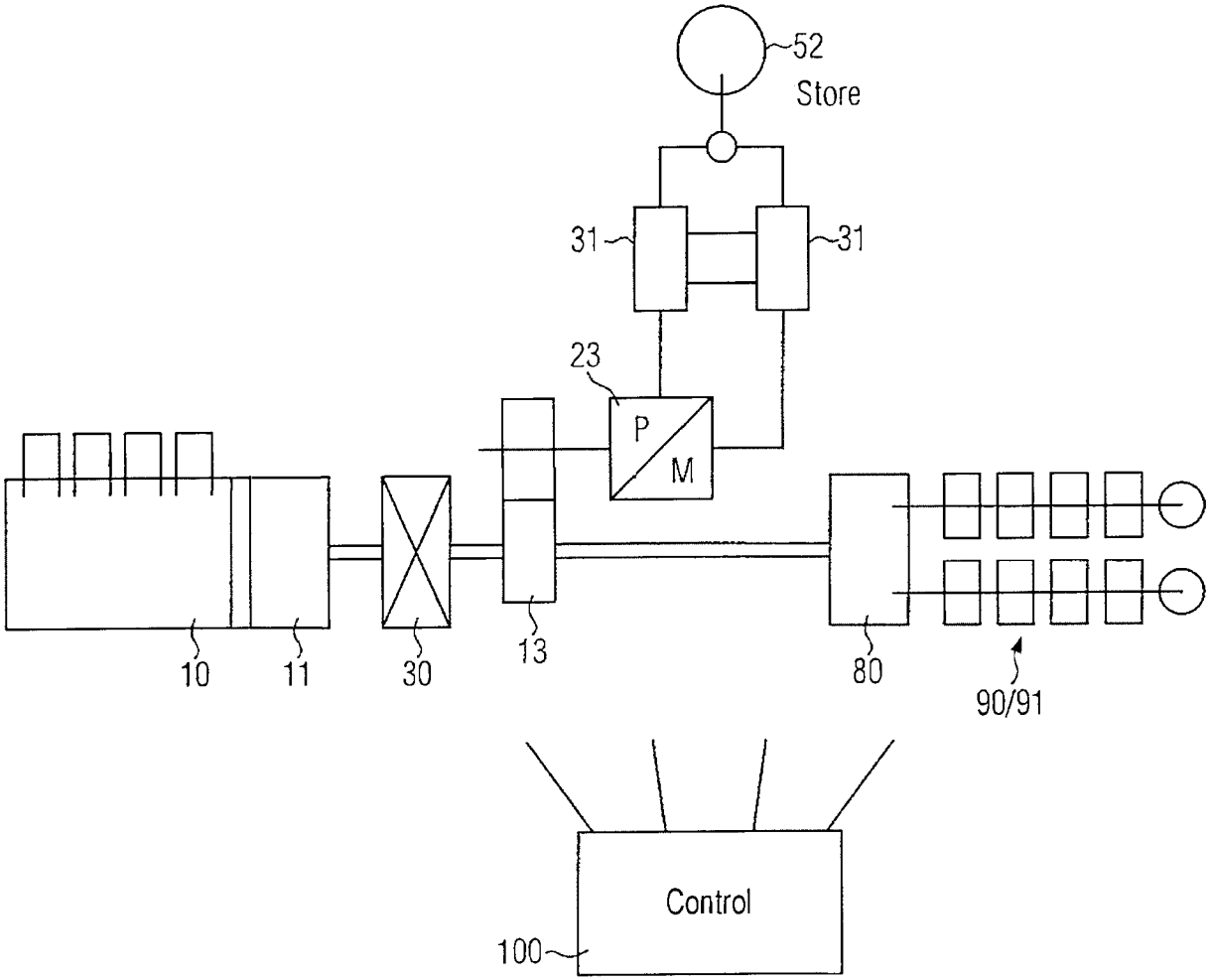
FIG. 7 shows a fifth embodiment of the mobile waste shredding device according to the invention.

FIG. 7 shows a fifth embodiment 210 of the mobile waste shredding device according to the invention, analogous to the second embodiment 110, which, however, is also based on a hydraulic and non-electric drive concept.

The same reference numerals here designate the same components as in FIG. 4 in embodiment 110. Therefore, only the additional components are described below.

These two embodiments 110 and 210 differ essentially in that the generator/motor unit 73 of embodiment 110 is replaced by a hydraulic pump/motor unit 23 of design 210.

As a result, the energy store 50 is also a hydraulic accumulator 52. As a result, the regulating and control units 31 in the energy store circuit also change analogously. Otherwise, embodiment 210 is identical to embodiment 110 except for the hydraulic pump/motor unit 73, which also includes the components and their function.

Embodiment 220

Figure 8:
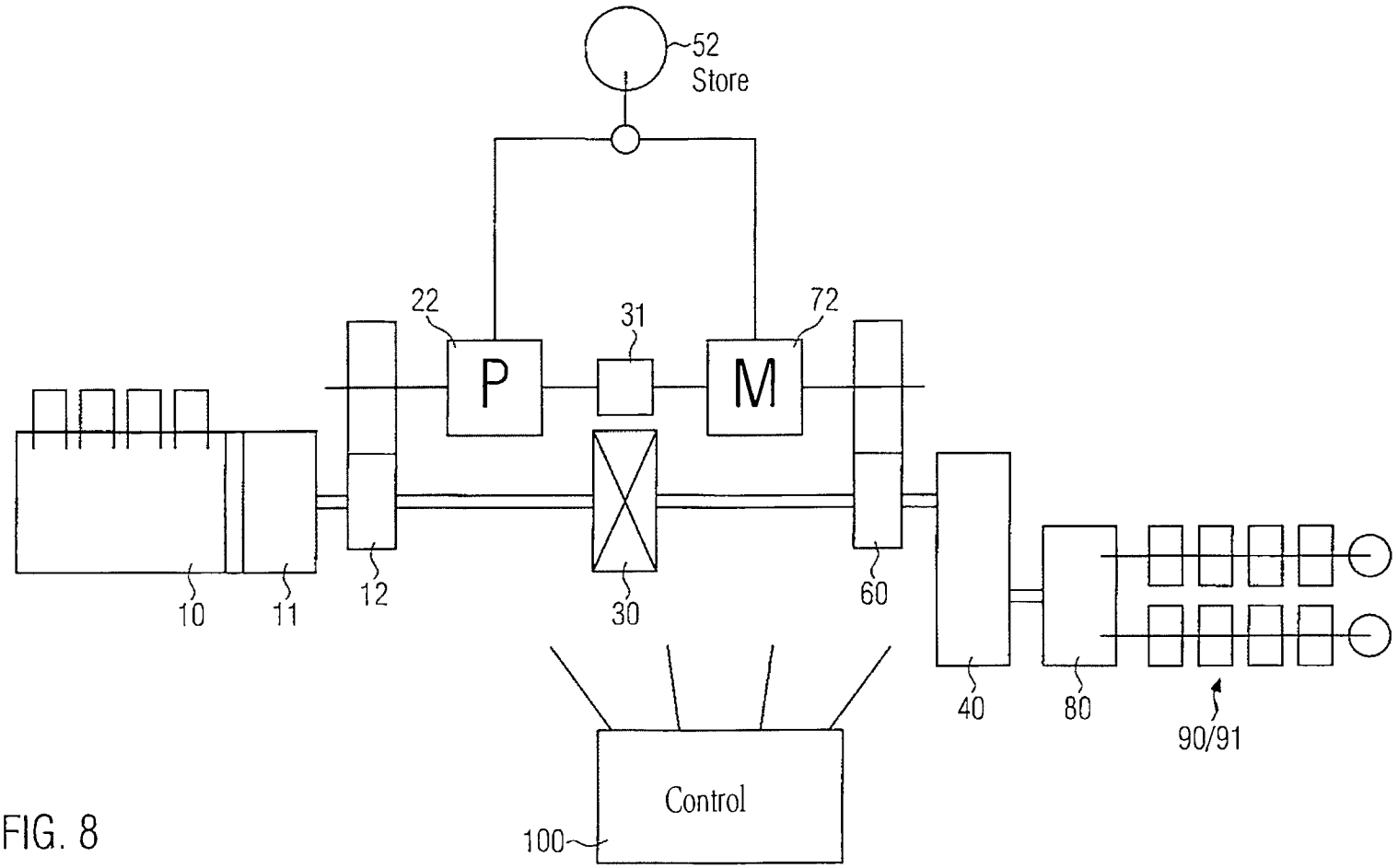
FIG. 8 shows a sixth embodiment of the mobile waste shredding device in accordance with the invention.

FIG. 8 shows a further sixth embodiment 220 of the mobile waste shredding device in accordance with the invention, analogous to the third embodiment 120, which, however, is based on a hydraulic and non-electric drive concept.

The same reference numerals here designate the same components as in FIG. 5 in embodiment 120. Therefore, only the additional components are described below.

These two embodiments differ essentially in that the generator 20 and electric motor 70 of embodiment 120 are replaced by the hydraulic pump 22 and the hydraulic motor 72 of embodiment 220.

The embodiment 220, like the embodiment 120 contains a continuously variable transmission between the 60 transmission and the main 80 transmission, but with a hydrostatic and non-hydraulic drive concept.

The embodiments shown are only exemplary and the complete scope of the present invention is defined by the claims.

The invention claimed is:

1. A mobile waste shredding device comprising:

at least one shredding shaft configured to shred input material;

an internal combustion engine;

a first and a second powertrain between the internal combustion engine and the shredding shaft;

at least one energy converter coupled to the internal combustion engine in the first powertrain for converting mechanical energy of the internal combustion engine into storable energy;

at least one auxiliary motor supplied with the storable energy in the first powertrain for introducing mechanical energy into the first powertrain;

an energy store for storing at least part of the storable energy in an event of periods of low power demand and for at least partially supplying the at least one auxiliary motor with the storable energy in an event of periods of high power demand; and a control unit, wherein the second powertrain comprises a clutch for coupling the internal combustion engine to the at least one shredding shaft, wherein the control unit is adapted to control the mobile waste shredding device so that a reversing operation of the at least one shredding shaft is carried out with the clutch open and a direction of rotation of the at least one shredding shaft reversed with the at least one auxiliary motor supplied with an energy supply from the energy store.

2. The mobile waste shredding device according to claim 1, wherein the second powertrain comprises at least one selected from the group of (i) a main gear on the at least one shredding shaft, and (ii) a continuously variable gear for changing a rotational speed of the at least one shredding shaft.

3. The mobile waste shredding device according to claim 2, wherein a first transmission is provided in the second powertrain for adapting a ratio of a rotational speed of the internal combustion engine and a rotational speed of the at least one shredding shaft.

4. The mobile waste shredding device according to claim 3, wherein a second transmission is provided in the first powertrain for adapting the ratio of the rotational speed of the internal combustion engine and a rotational speed of the energy converter or adapting a ratio of a rotational speed of the first transmission and the rotational speed of the energy converter.

5. The mobile waste shredding device according to claim 4, wherein a third transmission is provided in the first powertrain for adapting the ratio of the speed of rotation of the internal combustion engine and a speed of rotation of the auxiliary motor or adapting the ratio of the rotational speed of the first transmission and the speed of rotation of the auxiliary motor.

6. The mobile waste shredding device according to claim 1, wherein a first transmission is provided in the second powertrain for adapting a ratio of a rotational speed of the internal combustion engine and a rotational speed of the at least one shredding shaft.

7. The mobile waste shredding device according to claim 6, wherein a second transmission is provided in the first powertrain for adapting the ratio of the rotational speed of the internal combustion engine and a rotational speed of the energy converter or adapting a ratio of a rotational speed of the first transmission and the rotational speed of the energy converter.

8. The mobile waste shredding device according to claim 7, wherein a third transmission is provided in the first powertrain for adapting the ratio of the speed of rotation of the internal combustion engine and a speed of rotation of the auxiliary motor or adapting the ratio of the rotational speed of the first transmission and the speed of rotation of the auxiliary motor.

9. The mobile waste shredding device according to claim 1, wherein the at least one energy converter and the at least one auxiliary motor form at least one energy converter/motor unit.

10. The mobile waste shredding device according to claim 9, wherein the at least one energy converter/motor unit is coupled to the second powertrain via a transmission.

11. The mobile waste shredding device according to claim 1, wherein the at least one energy converter and the at least one auxiliary motor form separate units which are each coupled to the second powertrain via a respective transmission.

12. The mobile waste shredding device according to claim 1, wherein the at least one energy converter comprises at least one generator and the at least one auxiliary motor comprises an electric motor.

13. The mobile waste shredding device according to claim 12, further comprising:

at least one AC/DC converter for converting alternating current from said at least one generator to direct current, a DC/AC converter for converting direct current to alternating current for said at least one electric motor, and an intermediate circuit disposed between said AC/DC converter and said DC/AC converter having an energy management module for coupling said energy storage, each electric motor being an alternating current motor.

14. The mobile waste shredding device according to claim 12, wherein the energy store comprises at least one selected from the group of (i) an electrical energy store, and (ii) a mechanical energy store;

wherein the electrical energy store comprises at least one selected from the group of (a) a rechargeable battery, (b) a capacitor, (c) a superconducting magnetic energy store, and (d) a static uninterruptible power supply (UPS);

wherein the mechanical energy store comprises at least one selected from the group of (x) a dynamic UPS, (y) a flywheel mass store, and (z) a flywheel store; and wherein, in a case of a mechanical energy store, the energy store further comprises a converter for converting electrical into mechanical and mechanical into electrical energy.

15. The mobile waste shredding device according to claim 1, wherein the at least one energy converter comprises at least one hydraulic pump and the at least one auxiliary motor comprises a hydraulic motor, further comprising a hydrostatic control unit.

16. The mobile waste shredding device according to claim 15, wherein the energy store comprises at least one hydraulic accumulator, wherein the hydraulic accumulator comprises a gas-filled pressure vessel, wherein the gas-filled pressure vessel comprises at least one selected from the group of (i)

a diaphragm accumulator, (ii) a bladder accumulator, (iii) a piston accumulator, (iv) a metal bellows accumulator, and (v) a spring accumulator.

17. The mobile waste shredding device according to claim 1, wherein a plurality of shredding shafts are provided.

18. The mobile waste shredding device according to claim 1, wherein an additional device for charging the energy store is provided.

19. The mobile waste shredding device according to claim 1, wherein the control unit is further adapted to control the mobile waste shredding device so that at least one selected from the group of (i) during a starting process and when the clutch is open, the auxiliary motor drives at least one shredding shaft by means of an energy supply from the energy store until a synchronous rotational speed to a first transmission is reached, whereupon the clutch is closed and the energy supply from the energy store is stopped; (ii) during a starting process and when the clutch is closed, the auxiliary motor is started by means of an energy supply from the energy store and the internal combustion engine drives the at least one shredding shaft and the energy supply from the energy store is subsequently stopped; (iii) if a torque required for the shredding increases and thus a rotational speed of the internal combustion engine falls below a minimum value, then the at least one shredding shaft is driven with energy supply from the energy store with the auxiliary motor (iv) if the torque provided is still insufficient or if the at least one shredding shaft is blocked, then the clutch is opened and a further power supply is also stopped via the auxiliary motor and (v) if a possible power of the internal combustion engine is not completely required for directly driving the at least one shredding shaft, then the energy store is charged via the energy converter.

* * * * *